US009477186B2

(12) United States Patent
Yahata et al.

(10) Patent No.: US 9,477,186 B2
(45) Date of Patent: Oct. 25, 2016

(54) IMAGE PROCESSING DEVICE AND IMAGE PROCESSING METHOD

(71) Applicants: KABUSHIKI KAISHA TOSHIBA, Tokyo (JP); TOSHIBA TEC KABUSHIKI KAISHA, Tokyo (JP)

(72) Inventors: Isao Yahata, Shizuoka (JP); Ken Iguchi, Shizuoka (JP); Takahiro Kawaguchi, Shizuoka (JP); Hiroyuki Taguchi, Shizuoka (JP); Hiroyuki Tsuchihashi, Shizuoka (JP); Hiroyuki Taki, Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/942,440

(22) Filed: Nov. 16, 2015

(65) Prior Publication Data

US 2016/0070215 A1 Mar. 10, 2016

Related U.S. Application Data

(60) Continuation of application No. 14/109,620, filed on Dec. 17, 2013, now Pat. No. 9,216,589, which is a division of application No. 13/042,432, filed on Mar. 7, 2011, now Pat. No. 8,644,752.

(60) Provisional application No. 61/312,069, filed on Mar. 9, 2010.

(51) Int. Cl.

| | |
|---|---|
| ***G03G 15/20*** | (2006.01) |
| ***G03G 15/00*** | (2006.01) |
| ***B41J 2/335*** | (2006.01) |

(52) U.S. Cl.

CPC ..... *G03G 15/2039* (2013.01); *B41J 2/335* (2013.01); *G03G 15/6502* (2013.01); *G03G 15/6573* (2013.01); *G03G 2215/00421* (2013.01)

(58) Field of Classification Search

CPC ..... G03G 21/1619; G03G 21/1647; G03G 15/6502; G03G 21/1676; G03G 21/1695; G03G 21/1821; G03G 21/1857; G03G 15/065; G03G 15/0817; G03G 15/502; G03G 15/6511; G03G 15/6564; G03G 15/80

See application file for complete search history.

(56) References Cited

U.S. PATENT DOCUMENTS

| | | | |
|---|---|---|---|
| 5,781,822 | A | 7/1998 | Nishiyama et al. |
| 2005/0141906 | A1 | 6/2005 | Murakami |

(Continued)

FOREIGN PATENT DOCUMENTS

| | | |
|---|---|---|
| JP | S61150939 | 7/1986 |
| JP | H06-250567 | 9/1994 |

(Continued)

OTHER PUBLICATIONS

English Translation of Chinese Office Action issued Apr. 7, 2013, filed in Chinese counterpart Patent Application No. 201110054502.9.

(Continued)

*Primary Examiner* — Roy Y Yi

(74) *Attorney, Agent, or Firm* — Patterson & Sheridan, LLP

(57) ABSTRACT

An image processing device has a first supplying portion that supplies a sheet on which an image is fixed previously. A removing portion removes the image formed on the sheet. A first storing portion stores the sheet from which the image is removed by the removing portion. The first supplying portion and the first storing portion are integrally formed as a unit capable of detaching from the main body of the image processing device.

15 Claims, 6 Drawing Sheets

(56) References Cited

U.S. PATENT DOCUMENTS

| | | | | |
|---|---|---|---|---|
| 2010/0290825 | A1 | 11/2010 | Iguchi | |
| 2010/0321456 | A1 | 12/2010 | Tsuchihashi et al. | |
| 2011/0222937 | A1 | 9/2011 | Yahata et al. | |
| 2011/0304881 | A1* | 12/2011 | Saitou | B41J 11/008 358/1.15 |

FOREIGN PATENT DOCUMENTS

| | | |
|---|---|---|
| JP | H06-099644 | 12/1994 |
| JP | H06-332340 | 12/1994 |
| JP | H08-110739 | 4/1996 |
| JP | 2001-249588 | 9/2001 |
| JP | 2006-347049 | 12/2006 |

OTHER PUBLICATIONS

English Translation of Japanese Office Action mailed Sep. 3, 2013, filed in Japanese counterpart Patent Application No. 2011-051285.

English Translation of Japanese Office Action mailed Nov. 18, 2014, filed in Japanese counterpart Patent Application No. 2014-004712.

* cited by examiner

IMAGE PROCESSING DEVICE AND IMAGE PROCESSING METHOD

CROSS-REFERENCE TO RELATED APPLICATION

This application is a continuation of U.S. patent application Ser. No. 14/109,620, filed on Dec. 17, 2013, which is a division of U.S. patent application Ser. No. 13/042,432, filed on Mar. 7, 2011, now issued as U.S. Pat. No. 8,644,752 on Feb. 4, 2014, which is based upon and claims the benefit of priority from U.S. Provisional Patent Application No. 61/312,069, filed on Mar. 9, 2010; the entire contents of each of the applications are incorporated herein by reference.

FIELD

The present invention relates to a technique of fixing an image on a sheet and a technique of removing the image fixed on the sheet.

BACKGROUND

There is an image removing unit for removing an image on a printed sheet using a toner which is made to become colorless by heating the sheet at a temperature higher than the fixing temperature on the sheet during printing.

When this kind of image removing unit is disposed separately to an image forming device, space for disposing the image removing unit is required.

DETAILED DESCRIPTION

An image processing device has an image forming portion, a heating portion and a supplying portion. The image forming portion forms images on a sheet. The heating portion heats the sheet on which an image is formed by the image forming portion at a predetermined temperature, to thereby fix the image on the sheet. The supplying portion supplies the sheet to which an image is fixed previously. Further, the heating portion heats the sheet, which is supplied from the supplying portion and to which the image is fixed, at a temperature higher than the predetermined temperature to thereby remove the image.

The embodiment described below provides a technique of removing an image using a unit provided in the image forming unit.

The embodiment will be described with reference to drawings. Further, in the embodiment, toner is fixed on a sheet at the predetermined temperature (in the embodiment, a temperature in the range of about 80 to 130° C.). The toner used has the property of becoming colorless when heated at a temperature higher than a fixing temperature.

Figure 1:
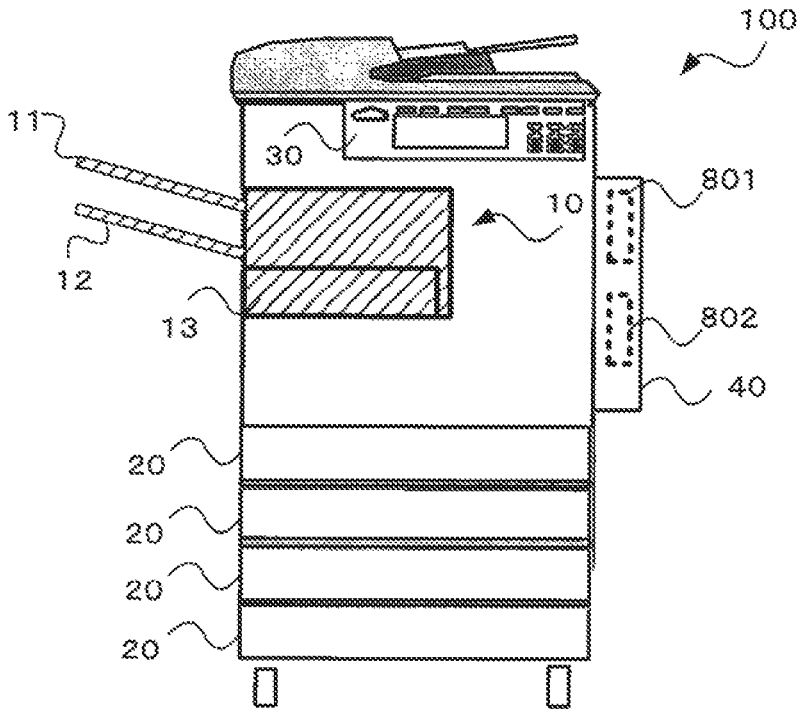
FIG. 1 is a schematic view showing an image processing device.

FIG. 1 is a view showing the image processing device of the embodiment. The image processing device 100 has a tray unit 10, a cassette 20, a control panel 30 and a control unit 40.

The tray unit 10 can be taken out from and fitted into the main body of the image processing device 100. The tray unit 10 includes the respective trays of a reuse sheet supplying tray 11, a fixing sheet holding tray 12, and an erased sheet holding tray 13.

The reuse sheet supplying tray 11 holds a sheet to be erased, and supplies the sheet to be erased to the interior of the image processing device 100. The fixing sheet holding tray 12 stores in a stacked manner the sheets to which an image is fixed by the image processing device 100. The erased sheet holding tray 13 stores in a stacked manner sheets from which an image is removed by the image processing device 100.

The cassette 20 holds the sheet for printing according to size, and supplies the sheet to be used during printing to the image processing device 100.

The control panel 30 has a touch panel display or a keyboard, receives the designation of parameters or processing execution instructions from a user, and displays the processing progress or the apparatus status to the user.

The control unit 40 is a unit performing overall control of the hardware of the image removing unit 100, and has a processor 801 that is an arithmetic processing unit (for example, a Central Processing Unit (CPU)) and a memory 802 that is a storage device composed of volatile and non-volatile memory. The processor 801 has the role of performing various processes in the image processing device 100, and also has the role of realizing various functions by carrying out programs stored in the memory 802. For example, the memory 802 can be configured of RAM (Random Access Memory), ROM (Read Only Memory), DRAM (Dynamic Random Access Memory), SRAM (Static Random Access Memory), VRAM (Video Ram), an HDD (Hard Disk Drive) or the like. The memory 802 has the role of storing a variety of information or programs to be used in the image removing unit 100. Further, the memory 802 stores data or programs which need to be stored in non-volatile memory. The function realized using the processor 801 and memory 802 may be realized by mounting an Application Specific Integrated Circuit (ASIC).

Next, in conjunction with an internal configuration of the image processing device 100 shown in FIG. 2, a carrying path of a general printing process will be described.

The image processing device 100 has a carrying portion 14, a drum 15, a heating unit 16 and a printing confirmation sensor 17 in addition to a reuse sheet supplying tray 11, a fixing sheet holding tray 12 and an erased sheet holding tray 13, as described above. The drum 15 transcribes a toner image to a sheet supplied from a cassette 20 to thereby form an image on the sheet. The heating unit 16 heats the sheet at the predetermined temperature to thereby fix the toner image on the sheet. The carrying portion 14 transfers the sheet to the drum 15, the heating unit 16, the printing confirmation sensor 17, and the trays 11 to 13. The carrying portion 14 is composed of flappers F1 to F4 switching the plurality of the carrying rollers or the carrying paths, and a carrying belt. The printing confirmation sensor 17 will be described below.

A carrying path when one surface of the sheet is printed will be described. The sheet supplied from the cassette 20 is carried to a drum 15 through paths R1 and R2 of FIG. 2 by the carrying portion 14. After a toner image is formed in the drum 15, the sheet is carried next to the heating unit 16, and heated and pressed at the predetermined temperature to thereby fix the toner image on the sheet. The sheet on which an image is fixed passes through path R3 based on switching control by a flapper F4 (flappers F1 to F4 are controlled by a switching signal from the control unit 16), and is carried to the fixing sheet holding tray 12 through paths R4 and R5 based on switching control by the flapper F3.

Next, a carrying path when both surfaces of the sheet are printed will be described. In the case of printing both surfaces of the sheet, the sheet travels along paths R1 and R2, the drum 15 forms a toner image on the sheet and the heating unit 16 fixes the image on the sheet. Then, the sheet is carried to R6 by path switching by the flappers F4 and F2 and a roller 51 pinches the sheet.

The roller 51 where the sheet is in a pinched state is reversely rotated, furthermore, the flapper F2 switches the path, whereby the sheet travels along the paths R7, R8, and R2. Then, the sheet is carried to the drum 15, and at this time, the surface of the sheet opposed to the drum 15 is reversed with respect to the previous surface. Therefore, the drum 15 forms a toner image on the back surface of the surface on which the image is previously formed. In the same manner, the heating unit 16 also heats the back surface of the sheet at the predetermined temperature such that a toner image is fixed on the back surface of the sheet.

The sheet on which a toner image is fixed on both surfaces in this way is carried to the fixing sheet holding tray 12, through the paths R3, R4, and R5 by the switching of the paths by the flappers F4 and F3.

Figure 2:
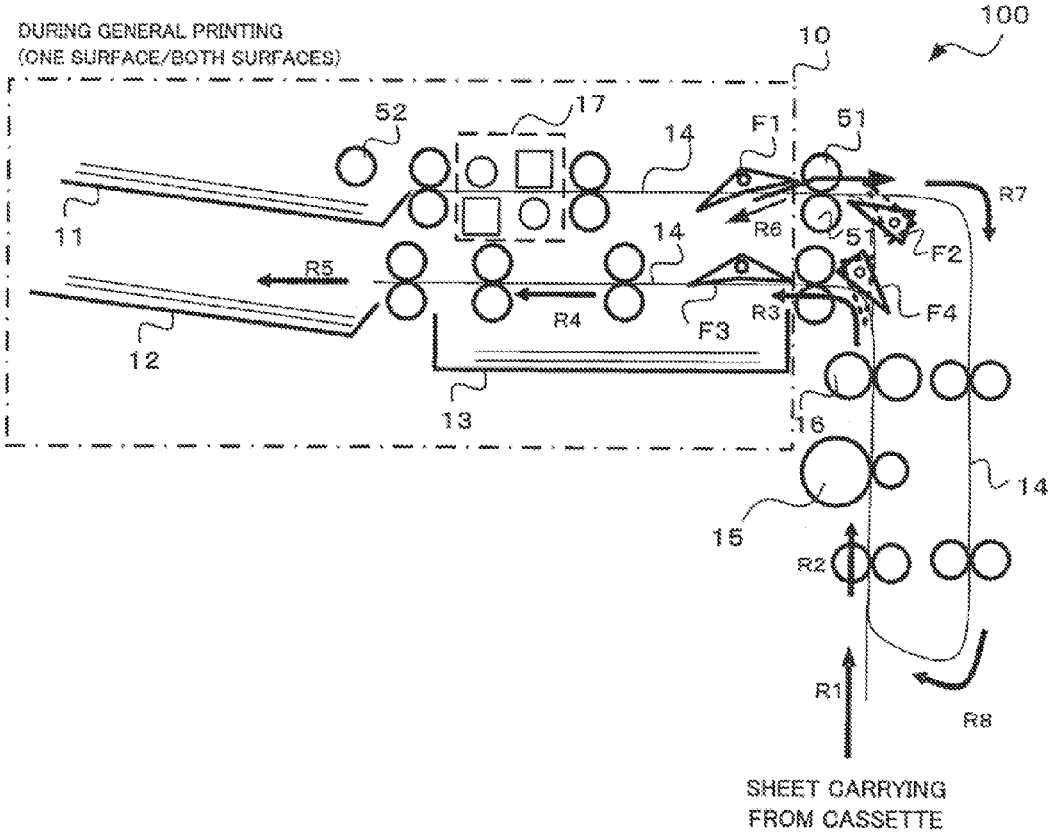
FIG. 2 is a view showing one example of a hardware configuration of an image processing device and one example of a sheet carrying path during printing.

Further, the tray unit 10 is composed of respective units surrounded by the dashed and dotted line in FIG. 2.

Here, the printing confirmation sensor 17 will be described before describing the operation of removing an image on a sheet. The image processing device 100 detects whether an image is formed and fixed on one surface or both surfaces of the sheet using the printing confirmation sensor 17 before removing the image. Two CCDs (Charge Coupled Device Image Sensors, hereinafter referred to as CCD) are mounted on the printing confirmation sensor 17, one of which takes images of one surface of the sheet and the other of which takes images of the other surface of the sheet. The control unit 40 determines whether images are formed on one surface or both surfaces using imaging data obtained by the CCDs, and when an image is formed on one surface, the control unit determines which surface the image is formed on. Further, the control unit 40 controls the operation of the flappers F1 to F4 based on this determination.

Figure 3:
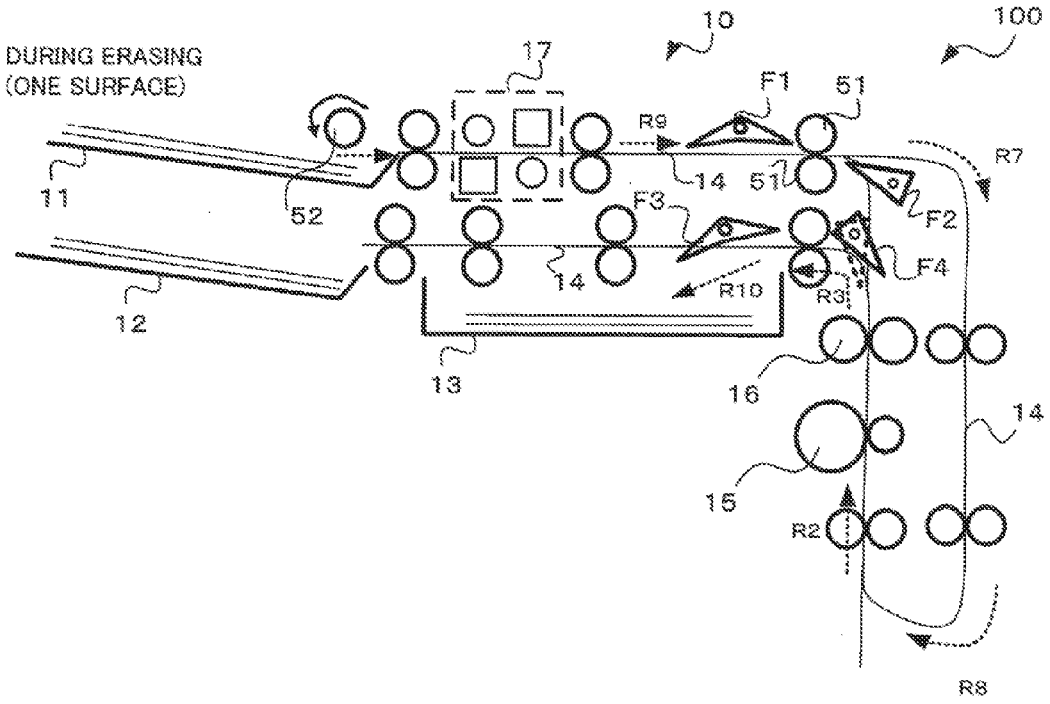
FIG. 3 is a view showing one example of a hardware configuration of an image processing device and one example of a sheet carrying path during the erasing one surface of the sheet.

FIG. 3 shows a carrying path when an image of one surface of the sheet is removed. Further, a pickup roller 52 of the reuse sheet supplying tray 11 supplies the disposed sheet to the interior of the image processing device 100. The carrying portion 14 transfers the sheet to the printing confirmation sensor 17, and determines whether images are formed on one surface or both surfaces (here, determines that an image is formed on one surface of the sheet). Then, the sheet is carried up to R9.

The sheet is carried along the paths R7, R8, and R2 due to carrying path switching by the flappers F1 and F2. Then, the carrying portion 14 transfers the sheet to the drum 15 (at this time, the drum 15 does not form an image) and transfers the sheet to the heating unit 16.

The heating unit 16 to which the sheet is carried heats the sheet for a predetermined time at a temperature higher than the printing temperature. The sheet is heated at a temperature higher than the printing temperature to thereby remove images due to the toner properties.

The sheet on which the erasing processing is carried out is carried to the path R3 by the guiding of the flapper F4 of the carrying portion 14 and then to the erased sheet holding tray 13 by the guiding of the flapper F3.

Next, the carrying path when images on both surfaces of the sheet are removed will be described using FIG. 4. The sheet disposed in the reuse sheet supplying tray 11 is carried by the carrying portion 14 through paths R9, R7, R8 and R2 in a similar manner to the one surface removing in FIG. 3, and is carried to the heating unit 16 through the drum 15. The heating unit 16 heats one surface of the sheet to thereby remove the image from that surface.

Then, based on the guiding of the flappers F4 and F2, the sheet is carried to R6 and pinched by the roller 51. Here, the roller 51 is reversely rotated, whereby the sheet is carried through the paths R7, R8, and R2 by the path switching of flapper F2 and carried to the heating unit 16 through the drum 15. At this time, the surface of the sheet in contact with the heating unit 16 is the reverse surface of the surface erased previously. The heating unit 16 heats the surface of the sheet presently in contact with the heating unit 16 at a temperature higher than the temperature during printing for the predetermined time to thereby remove the image fixed on the sheet.

The sheet from which the images of both surfaces are thus removed is carried to path R3 by the guiding of the flapper F4 and is carried to the erased sheet holding tray 13 by the guiding of the flapper F3.

Figure 4:
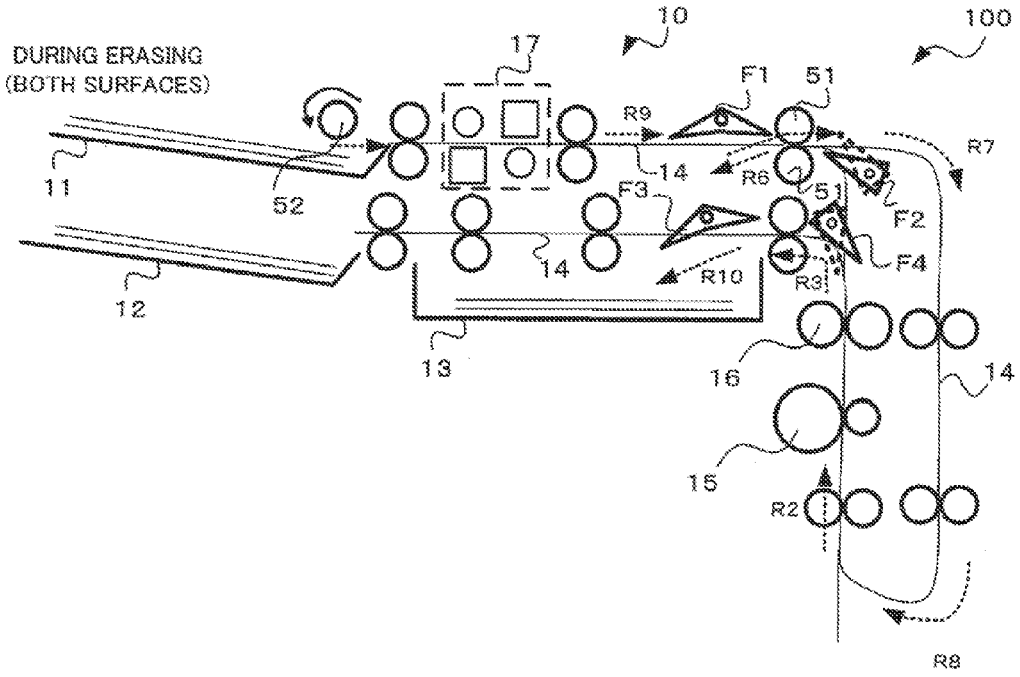
FIG. 4 is a view showing one example of a hardware configuration of an image processing device and one example of a sheet carrying path during the erasing of both surfaces of the sheet.

As described using FIGS. 2 to 4, in the embodiment, the heating unit 16 carries out the fixing of an image and the removing of an image, furthermore, common carrying paths (R7, R8, R2, R3, and R6) are used for the fixing of an image and the removing of an image.

Figure 5:
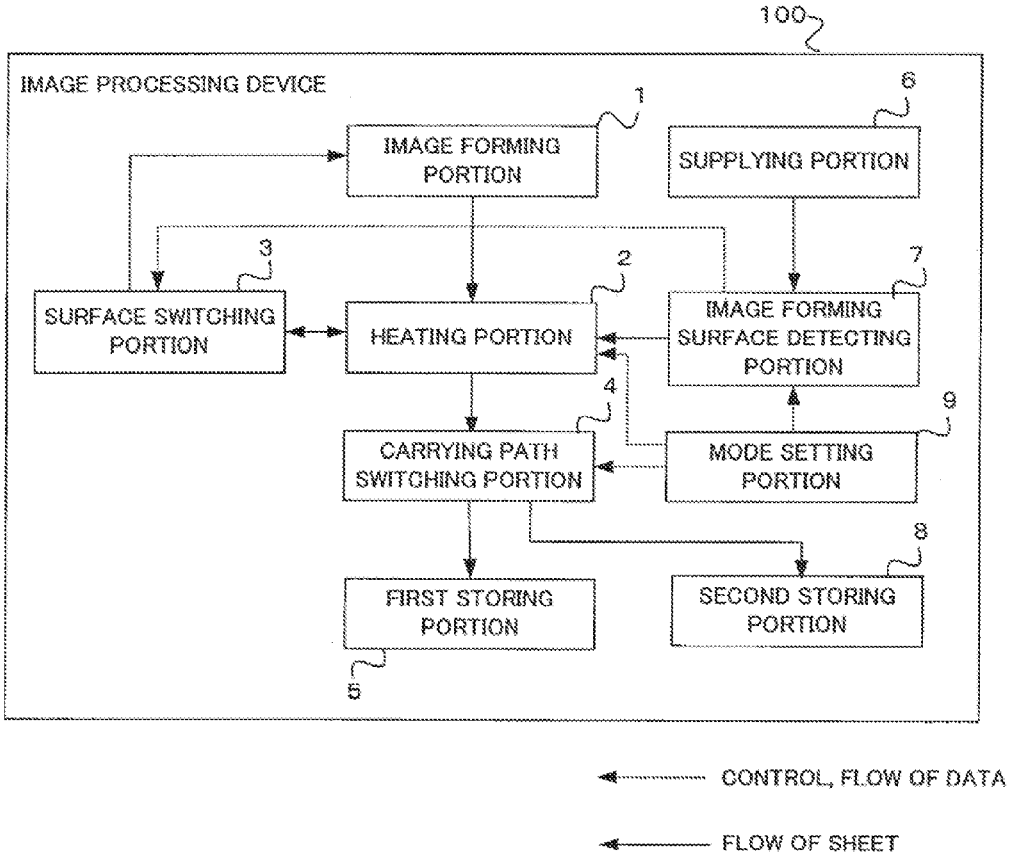
FIG. 5 is a view showing one example of a block diagram of an image processing device.

Next, FIG. 5 shows a block diagram of the image processing device 100. The image processing device 100 has the image forming portion 1, the heating portion 2, the surface switching portion 3, the carrying path switching portion 4, the first stacking portion 5, the supplying portion 6, the image forming surface-detecting portion 7, the second stacking portion 8 and the mode setting portion 9.

The image forming portion 1 includes the drum 15 and forms an image on a sheet supplied from the cassette 20. The heating portion 2 includes the heating unit 16 and heats the sheet at the predetermined temperature, to thereby fix the image formed by the image forming portion 1 on the sheet. Further, the heating portion 2 heats the sheet on which the image is fixed at a temperature higher than the predetermined temperature, to thereby remove the image. The surface switching portion 3 includes the flappers F4 and F2, and the roller 51 of the carrying portion 14; and the paths R6, R7 and R8 of the carrying portion 14; and switches the surface of the sheet heated by the heating portion 2 to the other surface.

The carrying path switching portion 4 includes the flapper F3 of the carrying portion 14, and switches the carrying path so that the carrying destination of the sheet from the heating portion 2 becomes the first stacking portion 5 or the second stacking portion 8. The first stacking portion 5 is the fixing sheet holding tray 12 to store the sheet on which images are fixed by the heating portion 2.

The supplying portion 6 is a reuse sheet supplying tray 11 and supplies the sheet on which an image is fixed previously. The image forming surface detecting portion 7 contains the printing confirmation sensor 17, and determines whether images are formed on one surface or both surfaces of the sheet supplied from the supplying portion 6. The second stacking portion 8 is the erased sheet holding tray 13 to store the sheet from which the image is erased by the heating portion 2.

The mode setting portion 9 contains the control panel 30 and obtains instructions from the user and sets the printing mode or removing mode based on the instructions of the user. Information set by the mode setting portion 9 is output to the heating portion 2, the carrying path switching portion 4 and the image forming surface detecting portion 7, shown as a broken arrow in FIG. 2 and output to the image forming portion 1 and supplying portion 6, not shown. Respective units obtaining setting information of the mode setting portion 9 operate according to the printing processing or the removing processing.

As described above, respective blocks shown in FIG. 5 will be described with respect to the respective hardware of FIGS. 1 to 4, but the control unit 40 controls the operation of the respective blocks and serial operation between blocks. That is, programs stored in the non-volatile memory area of memory 802 in advance are loaded to the volatile memory area of the memory 802 and the processor 801 executes the loaded programs such that the respective blocks of FIG. 5 are controlled.

Figure 6:
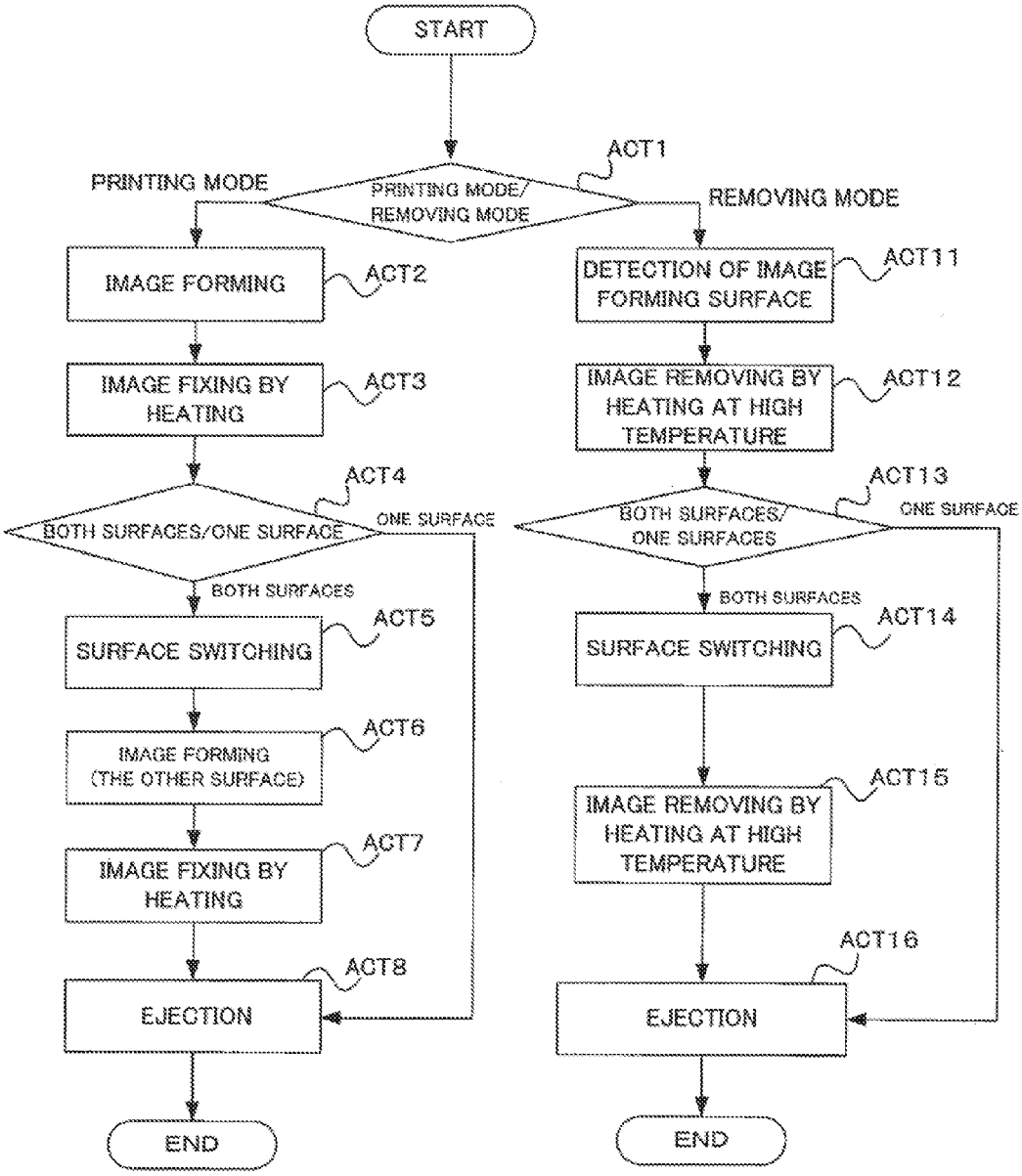
FIG. 6 is a flow chart showing one example of an operation of an image processing device.

The operation of image processing device 100 will be described with reference to the flow chart of FIG. 6.

A user inputs either of the printing mode or the removing mode to the control panel 30, and the mode setting portion 9 obtains the input information and sets the printing mode or the removing mode (the value is stored in a predetermined area of memory 802).

First, the operation of the printing mode will be described. In the case of the printing mode (ACT1, printing mode), the image forming portion 1 forms a toner image on the sheet supplied from the cassette 20 (ACT2). The heating portion 2 heats the sheet at the predetermined temperature to thereby fix the image (ACT3). Then, whether printing is carried out on both surfaces or one surface is determined (ACT4). For example, in the case of a printing instruction from an external computer, discrimination is defined according to whether the printing is carried out on one surface or both surfaces in the transmitted printing job. Based on this definition, the control unit 40 determines printing on one surface or printing on both surfaces. Further, the settings in the image processing device 100 are determined based on the one surface printing mode or the both surfaces printing mode by the control unit 40.

In the case of the one surface printing (ACT4, one surface), processing proceeds to ACT8. In the case of the both surfaces printing (ACT4, both surfaces), the surface switching portion 3 turns the sheet back to the other surface (ACT5). The image forming portion 1 forms a toner image on the other surface (ACT6). The heating portion 2 heats the other surface of the sheet at the predetermined temperature to thereby fix the image (ACT7).

Then, the carrying path is switched by the carrying path switching portion 4 such that the sheet is carried to the first storing portion 5, and the carrying portion 14 ejects the sheet to the first storing portion 5 (ACT8).

When a plurality of the sheets is printed, ACT2 to ACT8 are repeatedly carried out.

The operation of the removing mode will be described below. In the case of the removing mode (ACT1, removing mode), the supplying portion 6 supplies the sheet disposed in the reuse sheet supplying tray 11 (sheet on which an image is fixed previously), the image forming surface detecting portion 7 determines to which surface an image is fixed and outputs the determination result to the surface switching portion 3 (ACT11). After determination by the image forming surface detecting portion 7, the sheet is carried to the heating portion 2 by the carrying portion 14, and the heating portion 2 heats the sheet at a temperature higher than the temperature at the time of fixing to remove the image (ACT12).

The surface switching portion 3 for obtaining the determination result of whether an image is formed on one surface or both surfaces controls whether or not surface switching is carried out based on this determination result. That is, when the determination result of the image forming surface detecting portion 7 is one surface (ACT13, one surface), processing proceeds to ACT16. On the other hand, when the determination result of the image forming surface detecting portion 7 is both surfaces (ACT13, both surfaces), the surface-switching portion 3 turns the sheet back to the other surface (ACT14), and the heating portion 2 heats the other surface of the sheet at a temperature higher than the temperature at the time of fixing to thereby remove the image (ACT15).

Then, the carrying path is switched by the carrying path switching portion 4 such that the sheet is carried to the second storing portion 8, and the carrying portion 14 ejects the sheet to the second stacking portion 8 (ACT16).

When there is a plurality of sheets to be erased, ACT11 to ACT16 are repeatedly carried out.

Further, in the embodiment described above, the heating unit 16 heats the sheet by contact with one surface of the sheet; however, a heating element in contact with the other surface may be provided, and heating elements may be provided for both surfaces of the sheet. As described above, at least when an image is removed, the surface switching need not be carried out.

As described above, according to the technique disclosed in the specification, the heating portion used during printing on a sheet can also be used when removing the image on the sheet. Therefore, there is no longer a need to newly install an image removing unit and thus space saving can be achieved.

While certain embodiments have been described, these embodiments have been presented by way of example only, and are not intended to limit the scope of invention. Indeed, the novel apparatus and methods described herein may be embodied in a variety of other forms; furthermore, various omissions, substitutions and changes in the form of the apparatus and methods described herein may be made without departing from the sprit of the inventions. The accompanying claims and their equivalents are intended to cover such forms or modifications as would fall within the scope and spirit of the inventions.

What is claimed is:

1. An image processing device comprising:

a first supplying portion configured to supply a sheet on which an erasable image has been previously fixed;

an erasing portion configured to erase the image formed on the sheet supplied by the first supplying portion;

a first storing portion configured to store the sheet on which the image was erased by the erasing portion; and a second storing portion configured to store the sheet on which the image is formed by an image forming portion, wherein the first supplying portion, the first storing portion, and the second storing portion are integrally formed together as a tray unit that is detachable from a main body of the image processing device.

2. The device according to claim 1, further comprising:

a second supplying portion configured to supply a sheet on which an image is not formed;

the image forming portion configured to form an image on the sheet supplied by the second supplying portion, wherein the erasing portion is a heating portion further configured to heat the sheet on which the image is formed by the image forming portion to thereby fix the image on the sheet.

3. The device according to claim 2, further comprising:

a carrying path-switching portion positioned downstream in a sheet conveying direction of the heating portion and configured to switch a carrying path such that a carried destination of the sheet from the heating portion is either of the first storing portion and the second storing portion.

4. The device according to claim 3, wherein the second storing portion is positioned downstream in the sheet conveying direction of the first supplying portion.

5. The device according to claim 1, wherein the first supplying portion is positioned higher than the first storing portion in a vertical height direction of the image processing device.

6. The device according to claim 1, further comprising:

a read portion configured to read the image formed on the sheet, wherein the tray unit includes the read portion.

7. The device according to claim 1, wherein the erasing portion is configured to heat the sheet supplied by the first supplying portion to a predetermined erasing temperature.

8. The device according to claim 1, further comprising:

a controller configured to control the image processing device to convey the sheet supplied by the first supplying portion to the erasing portion and then the first storing portion when the tray unit is attached to the main body of the image processing device.

9. An image processing device comprising:

a first supplying portion configured to supply a sheet on which an erasable image has been previously fixed;

an erasing portion configured to erase the image formed on the sheet supplied by the first supplying portion; and a first storing portion configured to store the sheet subjected to erasing by the erasing portion, wherein the first supplying portion and the first storing portion are integrally formed together as a tray unit that is detachable from a main body of the image processing device.

10. The device according to claim 9, further comprising:

a second supplying portion configured to supply a sheet having no image formed thereon;

an image forming portion configured to form an image on the sheet supplied by the second supplying portion;

a second storing portion configured to store the sheet on which the image is formed by the image forming portion; and a carrying path-switching portion positioned downstream in a sheet conveying direction of the erasing portion and configured to switch a carrying path such that a carried destination of the sheet from the erasing portion is either of the first storing portion and the second storing portion.

11. The device according to claim 10, wherein the second storing portion is positioned downstream of the first supplying portion in the sheet conveying direction.

12. The device according to claim 9, wherein the first supplying portion is positioned higher than the first storing portion in a vertical height direction of the image processing device.

13. The device according to claim 9, further comprising:

a read portion configured to read the image formed on the sheet, wherein the tray unit includes the read portion.

14. The device according to claim 9, further comprising:

a second supplying portion configured to supply a sheet on which an image is not formed to the image forming portion, wherein the erasing portion is a heating mechanism configured to heat the sheet supplied by the first supplying portion at a predetermined erasing temperature to erase the image on the sheet, and to heat the sheet on which the image is formed by the image forming portion to a predetermined fixing temperature lower than the predetermined erasing temperature to fix the image on the sheet.

15. The device according to claim 9, further comprising:

a controller configured to control the image processing device to convey the sheet supplied by the first supplying portion to the erasing portion and then the first storing portion when the tray unit is attached to the main body of the image processing device.

* * * * *